US009956699B2

(12) United States Patent
Broad et al.

(10) Patent No.: US 9,956,699 B2
(45) Date of Patent: May 1, 2018

(54) CUTTING APPARATUSES

(71) Applicant: The Procter & Gamble Company, Cincinnati, OH (US)

(72) Inventors: Gavin John Broad, Liberty Township, OH (US); Mark Mason Hargett, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days. days.

(21) Appl. No.: 14/266,850

(22) Filed: May 1, 2014

(65) Prior Publication Data

US 2014/0326118 A1 Nov. 6, 2014

Related U.S. Application Data

(60) Provisional application No. 61/818,935, filed on May 3, 2013.

(51) Int. Cl.
*B26D 1/42* (2006.01)
*B26D 5/12* (2006.01)
(Continued)

(52) U.S. Cl.
CPC ..... *B26D 1/42* (2013.01); *B26D 5/12* (2013.01); *B26D 5/16* (2013.01); *B26D 7/015* (2013.01);
(Continued)

(58) Field of Classification Search
CPC ..... B26D 1/626; B26D 1/62; B26D 1/605; B26D 1/60; B26D 1/42; B26D 2001/003;
(Continued)

(56) References Cited

U.S. PATENT DOCUMENTS 1,741,634 A * 12/1929 Krause ..... B26D 3/003 83/169
1,741,635 A * 12/1929 Krause ..... B26D 3/003 83/312
(Continued)

FOREIGN PATENT DOCUMENTS

EP 351632 A2 * 1/1990
JP 2005168999 A 6/2005

OTHER PUBLICATIONS

Gear Types and Geometry[online]. Davall, [retrieved on Mar. 5, 2016]. Retrived from the internet: <URL:www.davall.co.uk/davall-gears/gear-types-geometry/>.*
(Continued)

*Primary Examiner* — Jennifer Swinney
(74) *Attorney, Agent, or Firm* — Larry L. Huston

(57) ABSTRACT

The present disclosure is directed, in part, to a cutting apparatus comprising a drive shaft having a longitudinal axis, a drum configured to orbit the longitudinal axis when driven by the drive shaft, a first actuator, and a cutting assembly joined to the drum and configured to orbit the longitudinal axis with the drum. The cutting assembly comprises a second actuator operably engaged with a portion of the cutting assembly, and a cutting device driven by the second actuator. The second actuator is configured to rotate the cutting device at least 1,500 revolutions per minute during cutting of an article. The first actuator is operably engaged with a portion of the cutting assembly and is configured to reciprocate the cutting device in directions substantially parallel to the longitudinal axis as the cutting assembly orbits the longitudinal axis.

11 Claims, 16 Drawing Sheets

(51) Int. Cl.

| | |
|---|---|
| ***B26D 5/16*** | (2006.01) |
| ***B26D 7/01*** | (2006.01) |
| ***B26D 7/12*** | (2006.01) |
| *B26D 1/00* | (2006.01) |
| *B26D 7/20* | (2006.01) |

(52) U.S. Cl.
CPC ..... *B26D 7/12* (2013.01); *B26D 2001/0033* (2013.01); *B26D 2007/202* (2013.01); *Y10T 83/2185* (2015.04); *Y10T 83/4815* (2015.04)

(58) Field of Classification Search
CPC ..... B26D 5/16; B26D 7/018; Y10T 83/4815; B65G 47/848; B65J 2406/3454; B65J 2406/3542
USPC ..... 83/337, 338, 331, 715, 618, 621, 614, 83/329, 100, 177; 198/377.04
See application file for complete search history.

(56) References Cited

U.S. PATENT DOCUMENTS

| | | | | |
|---|---|---|---|---|
| 1,922,641 | A * | 8/1933 | Schutz et al. | 83/285 |
| 2,278,032 | A | 3/1942 | Youngman | |
| 2,425,484 | A | 8/1947 | Murrah | |
| 3,149,517 | A * | 9/1964 | Frydryk | 83/155 |
| 3,207,019 | A * | 9/1965 | Vanzo | B26D 1/04 83/277 |
| 3,319,500 | A * | 5/1967 | Siegenthaler et al. | 83/353 |
| 3,368,438 | A * | 2/1968 | Frydryk | 83/336 |
| 3,380,329 | A | 4/1968 | Mathe | |
| 3,641,857 | A | 2/1972 | Vande Castle | |
| 3,742,798 | A | 7/1973 | Gries | |
| 4,593,589 | A * | 6/1986 | Gherardi | 83/168 |
| 5,044,241 | A * | 9/1991 | Labrecque | 83/489 |
| 5,069,101 | A | 12/1991 | Kleemola | |
| 5,327,805 | A * | 7/1994 | Reichental | B26D 1/185 83/471.2 |
| 5,683,777 | A | 11/1997 | Dollhopf | |
| 5,765,460 | A | 6/1998 | Wathieu | |
| 7,975,584 | B2 * | 7/2011 | McCabe | 83/343 |
| 9,003,937 | B2 | 4/2015 | Nobukuni | |
| 9,016,176 | B2 | 4/2015 | Nobukuni | |
| 9,050,731 | B2 | 6/2015 | Nobukuni | |
| 2002/0119312 | A1 | 8/2002 | Iwata | |
| 2002/0125105 | A1 * | 9/2002 | Nakakado | 198/471.1 |
| 2003/0000934 | A1 | 1/2003 | Tanaka | |
| 2009/0320664 | A1 * | 12/2009 | Rayner | 83/438 |
| 2011/0081463 | A1 * | 4/2011 | Scaroni et al. | 426/231 |
| 2014/0326115 | A1 | 11/2014 | Broad et al. | |

OTHER PUBLICATIONS

Final Office Action case 12857M; U.S. Appl. No. 14/266,851: dated Nov. 2, 2015; 17 Pages.

* cited by examiner

CUTTING APPARATUSES

FIELD

The present disclosure generally relates to cutting apparatuses and, more particularly relates to cutting apparatuses configured to cut tow fibers, or bundles thereof, and other materials.

BACKGROUND

Cutting apparatuses are used in the manufacture of many products, such as consumer products. Different materials used in consumer products require various cutting equipment and cutting methods. The cutting equipment and methods are, at times, tailored to specific cutting operations for various materials.

Various cleaning articles, or portions thereof, are one type of consumer product that may require one or more cutting operations during their manufacture. These cleaning articles may be used for dusting and light cleaning, for example, or for other purposes. Cleaning articles, such as disposable dusters, have been developed which have limited re-usability. These disposable dusters may comprise brush portions made of synthetic fiber bundles, called tow fibers, attached to one or more layers of material, such as one or more layers of a nonwoven material. In other instances, the tow fibers may be attached to a rigid material or plate. The disposable cleaning article may be used for one job (e.g., several square meters of surface) and discarded, or may be restored and re-used for more jobs and then discarded.

It is desired in a disposable cleaning article to have tow fibers that are fluffy and somewhat separated from each other on their distal fiber ends or free fiber ends. Current cutting technologies, however, tend to "weld" or join together free fibers ends of the tow fibers leading to an aesthetically unpleasing look and feel and also may somewhat limit cleaning ability. Furthermore, such welding of the free fibers ends of the tow fibers may somewhat reduce the effectiveness of the tow fibers in picking up dust and dirt. What is needed are cutting devices for consumer products, such as disposable dusters, and other products, that produce a cleaner and sharper cut and reduce welding of fibers at their free fiber ends. Also needed are methods of cutting materials, such as tow fibers, that reduce welding of the fibers at their free fiber ends.

SUMMARY

In one form, the present disclosure is directed, in part, to a cutting apparatus that may comprise a drive shaft having a longitudinal axis, a drum configured to orbit the longitudinal axis when driven by the drive shaft, a first actuator, and a cutting assembly joined to the drum and configured to orbit about the longitudinal axis with the drum. The cutting assembly may comprise a second actuator operably engaged with a portion of the cutting assembly, and a cutting device driven by the second actuator. The second actuator may be configured to rotate the cutting device at least 1,500 revolutions per minute (or other speeds disclosed herein) during cutting of an article. The first actuator may be operably engaged with a portion of the cutting assembly and may be configured to reciprocate the cutting device in directions substantially parallel to the longitudinal axis as the cutting assembly orbits the longitudinal axis.

In another form, the present disclosure is directed, in part, to a cutting apparatus that may comprise a drive shaft having a longitudinal axis, a drum configured to orbit the longitudinal axis when driven by the drive shaft, and a barrel cam positioned at least partially intermediate the drive shaft and a portion of the drum. The barrel cam may comprise a track that forms a path that surrounds the longitudinal axis. The drum and the drive shaft may rotate relative to the barrel cam. The barrel cam may be fixed and not rotatable. The cutting apparatus may further comprise a cutting assembly joined to the drum and configured to orbit about the longitudinal axis with the drum. The cutting assembly may comprise a rack comprising a first end and a second end. The rack may extend in a direction parallel to, substantially parallel to, or transverse to the longitudinal axis between the first end and the second end. The cutting assembly may further comprise a compounding gear assembly that may comprise a plurality of gears comprising a first gear operably engaged with the rack. The first gear may be configured to travel at least partially intermediate the first end and the second end of the rack. The compounding gear assembly may further comprise a cutting device driven by the plurality of gears. The cutting device may rotate at least 8-15 times per each rotation of the first gear. The cutting assembly may further comprise a cam follower at least partially engaged with the track and configured to orbit about the longitudinal axis within the path of the track. The cam follower may be configured to move the first gear at least partially intermediate the first end and the second end of the rack when the cutting assembly is orbiting about the longitudinal axis to cause the cutting device to translate substantially parallel to the longitudinal axis.

BRIEF DESCRIPTION OF THE DRAWINGS

The above-mentioned and other features and advantages of the present disclosure, and the manner of attaining them, will become more apparent and the disclosure itself will be better understood by reference to the following description of non-limiting embodiments of the disclosure taken in conjunction with the accompanying drawings, wherein.

DETAILED DESCRIPTION

Figure 1:
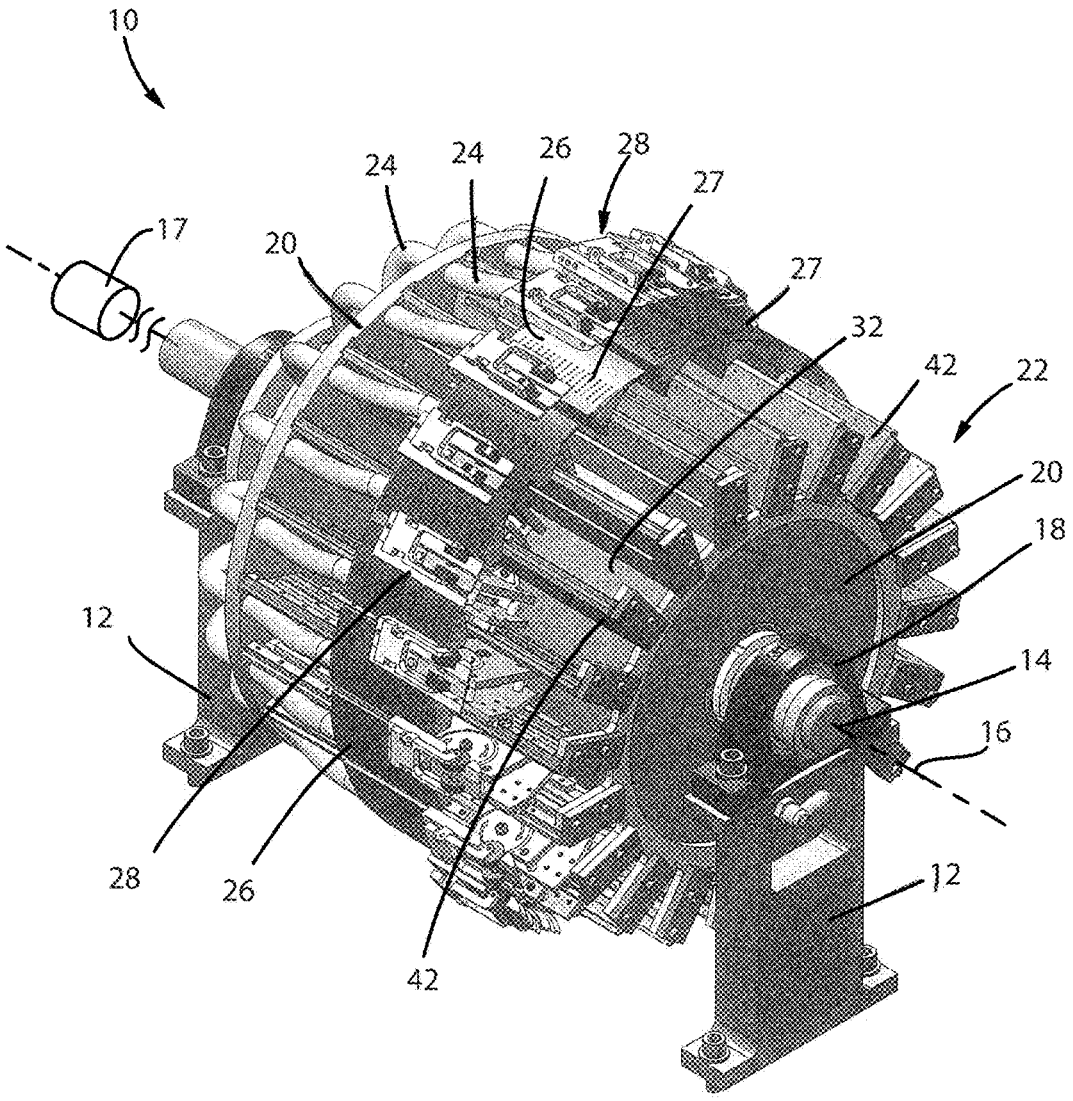
FIG. 1 is a front perspective view of a cutting apparatus comprising a plurality of cutting assemblies, wherein the cutting apparatus is mounted on two stands in accordance with a non-limiting embodiment of the present disclosure and schematically showing a motor, the schematic motor not being illustrated in the remaining views.
Figure 2:
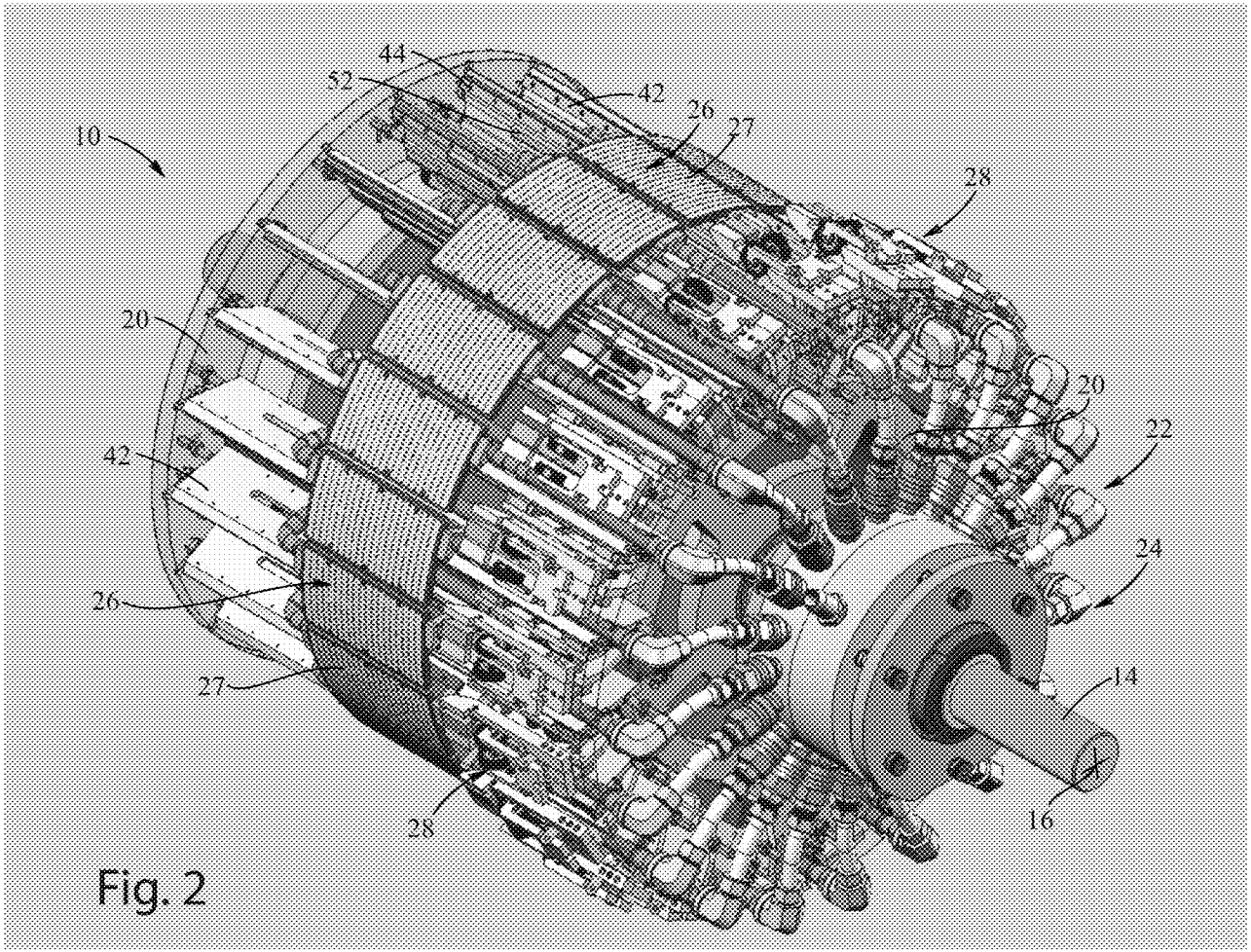
FIG. 2 is a rear perspective view of a cutting apparatus comprising a plurality of cutting assemblies in accordance with a non-limiting embodiment of the present disclosure.
Figure 3:
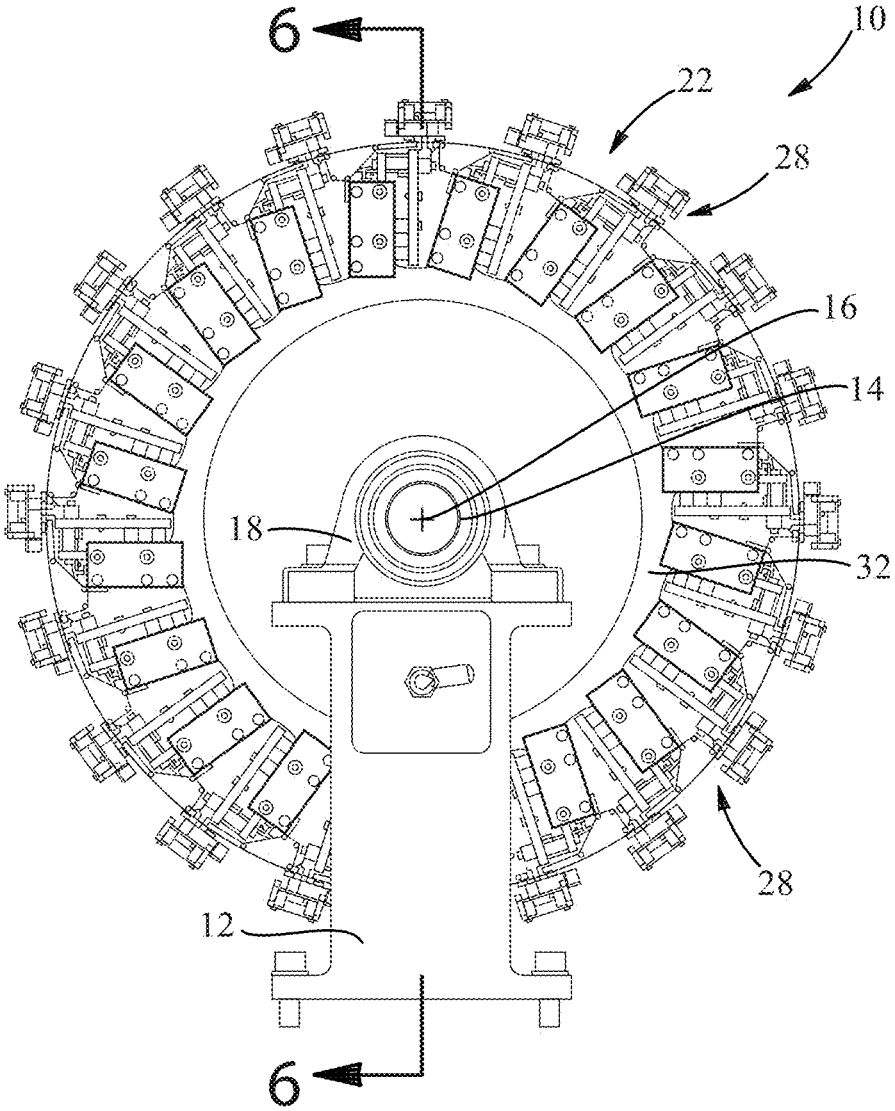
FIG. 3 is a front view of the cutting apparatus of FIG. 1 in accordance with a non-limiting embodiment of the present disclosure.
Figure 4:
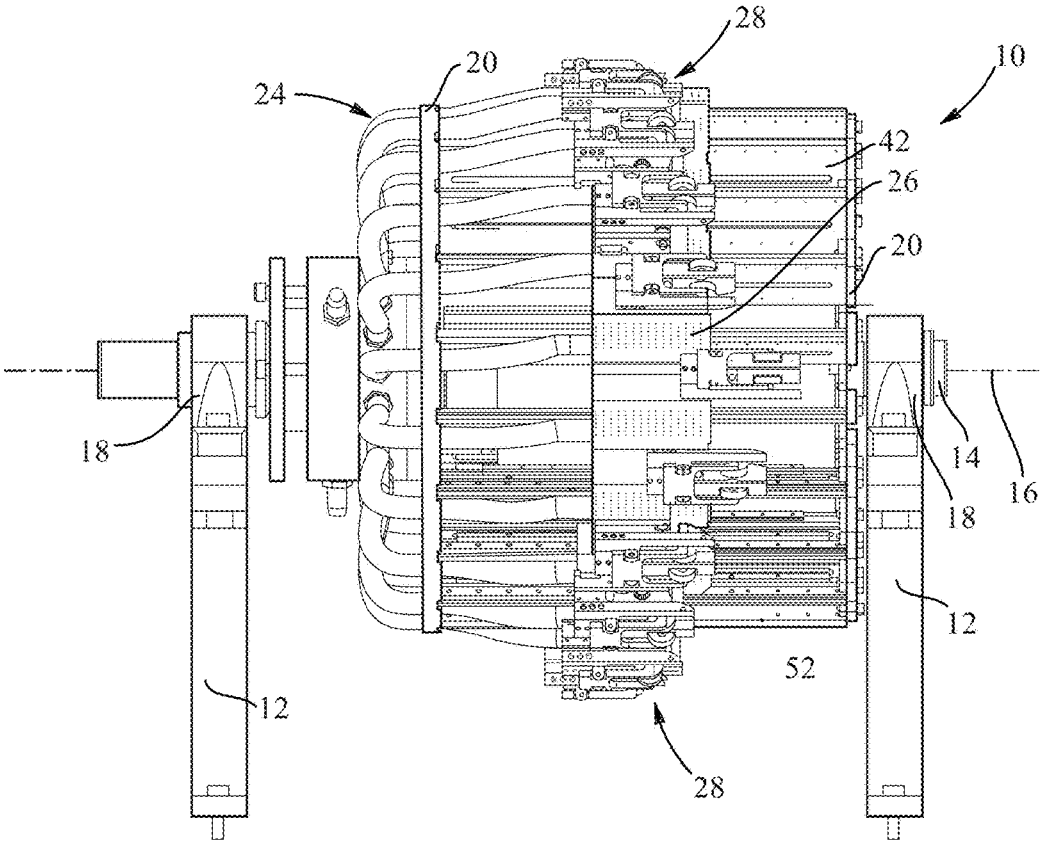
FIG. 4 is a side view of the cutting apparatus of FIG. 1 in accordance with a non-limiting embodiment of the present disclosure.

Various non-limiting embodiments of the present disclosure will now be described to provide an overall understanding of the principles of the structure, function, manufacture, and use of the cutting apparatuses and methods for cutting tow fibers, bundles thereof, and/or other materials or bundles thereof disclosed herein. One or more examples of these non-limiting embodiments are illustrated in the accompanying drawings. Those of ordinary skill in the art will understand that the cutting apparatuses and methods for cutting tow fibers, bundles thereof, and/or other materials or bundles thereof described herein and illustrated in the accompanying drawings are non-limiting example embodiments and that the scope of the various non-limiting embodiments of the present disclosure are defined solely by the claims. The features illustrated or described in connection with one non-limiting embodiment may be combined with the features of other non-limiting embodiments. Such modifications and variations are intended to be included within the scope of the present disclosure.

Definitions

The terms "joined," "attached," "mounted," "engaged," or "engaged with" encompass configurations wherein an element is directly secured to another element by affixing the element directly to the other element, and configurations wherein an element is indirectly secured to another element by affixing the element to intermediate member(s) which in turn are affixed to the other element.

The term "nonwoven" or "nonwoven material" refers herein to a material made from continuous (long) filaments (fibers) and/or discontinuous (short) filaments (fibers) by processes such as spunbonding, meltblowing, carding, and the like. Nonwovens do not have a woven or knitted filament pattern.

The term "machine direction" (MD) is used herein to refer to the primary direction of material, strip of substrate, or article flow through a process.

The term "cross direction" (CD) is used herein to refer to a direction that is generally perpendicular to the machine direction.

The present disclosure is directed to cutting and/or shearing apparatuses and methods of cutting and/or shearing. The terms cutting and shearing are used interchangeably herein, unless otherwise indicated. The cutting apparatuses may be used to cut any suitable material or materials, such as nonwoven materials, woven materials, natural fibers, synthetic fibers, cotton fibers, pulp fibers, tow fibers, other fibers, fibrous materials, laminates, and/or other materials, for example. The methods of cutting may also be used in cutting any suitable materials, such as nonwoven materials, woven materials, tow fibers, bundles of various types of fibers, and/or other materials, for example. The apparatuses and methods of the present disclosure may be used to cut one or more materials at a time or a single material at a time. If more than one material is cut at a time, the more than one materials may be the same or different.

The tow fibers referred to herein may be synthetic fibers or any other tow fibers as known to those of skill in the art. "Tow" generally refers to fibers comprising synthetic polymers including polyester, polypropylene, polyethylene, and cellulose materials including cellulose acetate and mixtures thereof manufactured such that the individual fibers are relatively long strands manufactured in bundles. The bundle fibers may be defined as any fibers having distinct end points and at least about 1 cm in length.

Frequently, in high speed consumer product manufacturing, a strip of a substrate is conveyed through a line in a machine direction or generally in a machine direction. Components may be added to the strip of the substrate or taken away from the strip of the substrate as the strip of the substrate moves in the machine direction. In some instances, the strip of substrate may be processed as they move in the machine direction, other than through the addition or removal of components. The strip of substrate may comprise one material or two or more materials that are joined together (i.e., a laminate). The strip of substrate may comprise any of the materials discussed herein in relation to the materials being cut or may comprise other materials, adhesives, lotions, oils, etc.

It is often necessary to cut the strip of the substrate into individual consumer products, or portions thereof, such as disposable dusters. This can be accomplished using a cutting apparatus comprising one or more cutting assemblies, such as the cutting apparatus comprising one or more cutting assemblies of the present disclosure. The cutting may occur in the cross-direction, or substantially in the cross direction (e.g., +/−30 degrees from the cross-direction), or may occur in other directions. After cutting, the consumer products, or portions thereof, may be moved in the machine direction, or other direction, on a conveyor or other device for further processing or packaging.

The cutting assemblies of the present disclosure are illustrated, as an example, as being part of a larger cutting apparatus. It will be understood, however, that the cutting assemblies of the present disclosure may be used in other cutting operations independent of the illustrated cutting apparatus and either with other cutting apparatuses or independently of another cutting apparatuses.

Some related art cutting assemblies for consumer products, or other fibrous products, have a tendency to weld or join free fiber ends of the fibers being cut together during cutting, especially tow fibers or bundles thereof, for example. The welding may occur due to slow cutting blade rotational speeds and/or due to the high pressures required to force a portion of a cutting blade through the material being cut and against a smooth anvil. In other instances, the welding may occur because the fibers are cut using crush cut methods, such as die cutting, for example. In these instances, as the fibers are crushed, they may be welded together. The cutting apparatuses and cutting assemblies of the present disclosure, however, provide less welding of free fiber ends, such as free fibers end of tow fibers, due to the unique configuration of the cutting apparatuses and cutting assemblies and the particular methods used for the cutting operation of the present disclosure. Furthermore, the cutting devices or blades of the present disclosure achieve speeds much higher than conventional cutting devices allowing for a much cleaner and more distinct cut that reduces free fiber end welding.

In an embodiment, referring to FIGS. 1-6, an example cutting apparatus 10 is disclosed. The cutting apparatus 10 may take the form a rotating device or other suitable device. The cutting apparatus 10 may be positioned on stands 12, or otherwise mounted, and may comprise a drive shaft 14 having a longitudinal axis 16. The drive shaft 14 may be rotated about the longitudinal axis 16 by an actuator, such as a motor 17, a drive belt or chain engaged with an actuator, or other actuation methods or devices known to those of skill in the art. The drive shaft 14 may be held in place by brackets 18 or other suitable device. The drive shaft 14 should be rotatable with respect to the brackets 18 using bearings or other device that permits rotation of the drive shaft 14 while allowing it to remain in place. The drive shaft 14 may be rigidly engaged with rotating plates 20 such that the rotating plates 20 rotate in unison with the drive shaft 14 about the longitudinal axis 16. The two rotating plates 20 together form a portion of a drum 22. In additional to the rotating plates 20, the drum 22 is considered to be any member that rotates about the longitudinal axis 16 and/or that has a portion of a cutting assembly mounted or joined thereto. Examples of portions of the drum 22 are portions of a fluid movement system 24, one or more transfer heads 26, and any structures that support one or more the cutting assemblies. The drum 22 is configured to orbit about the longitudinal axis 16 when driven by the drive shaft 14. Alternatively, the drum 22 may be surface driven in known fashion.

Figure 5:
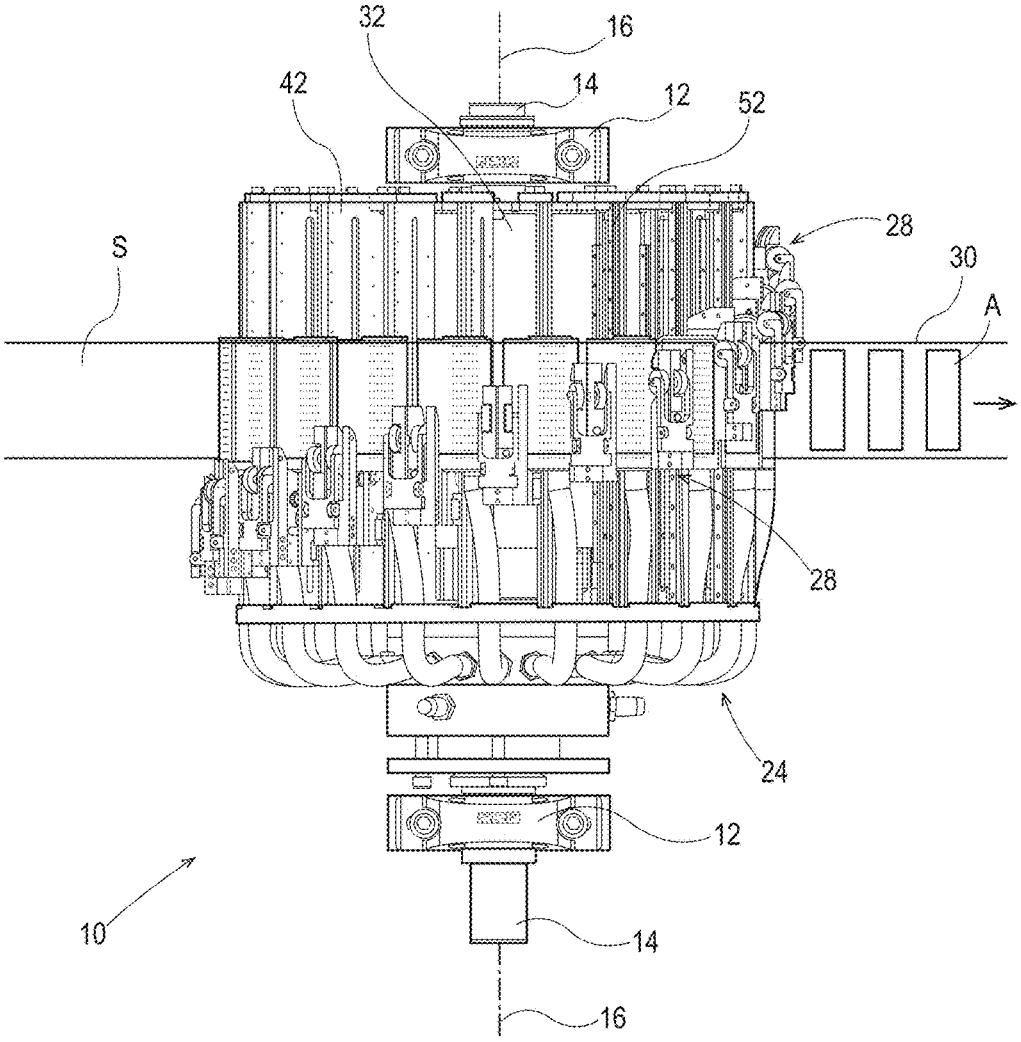
FIG. 5 is a top view of the cutting apparatus of FIG. 1 in accordance with a non-limiting embodiment of the present disclosure.
Figure 6:
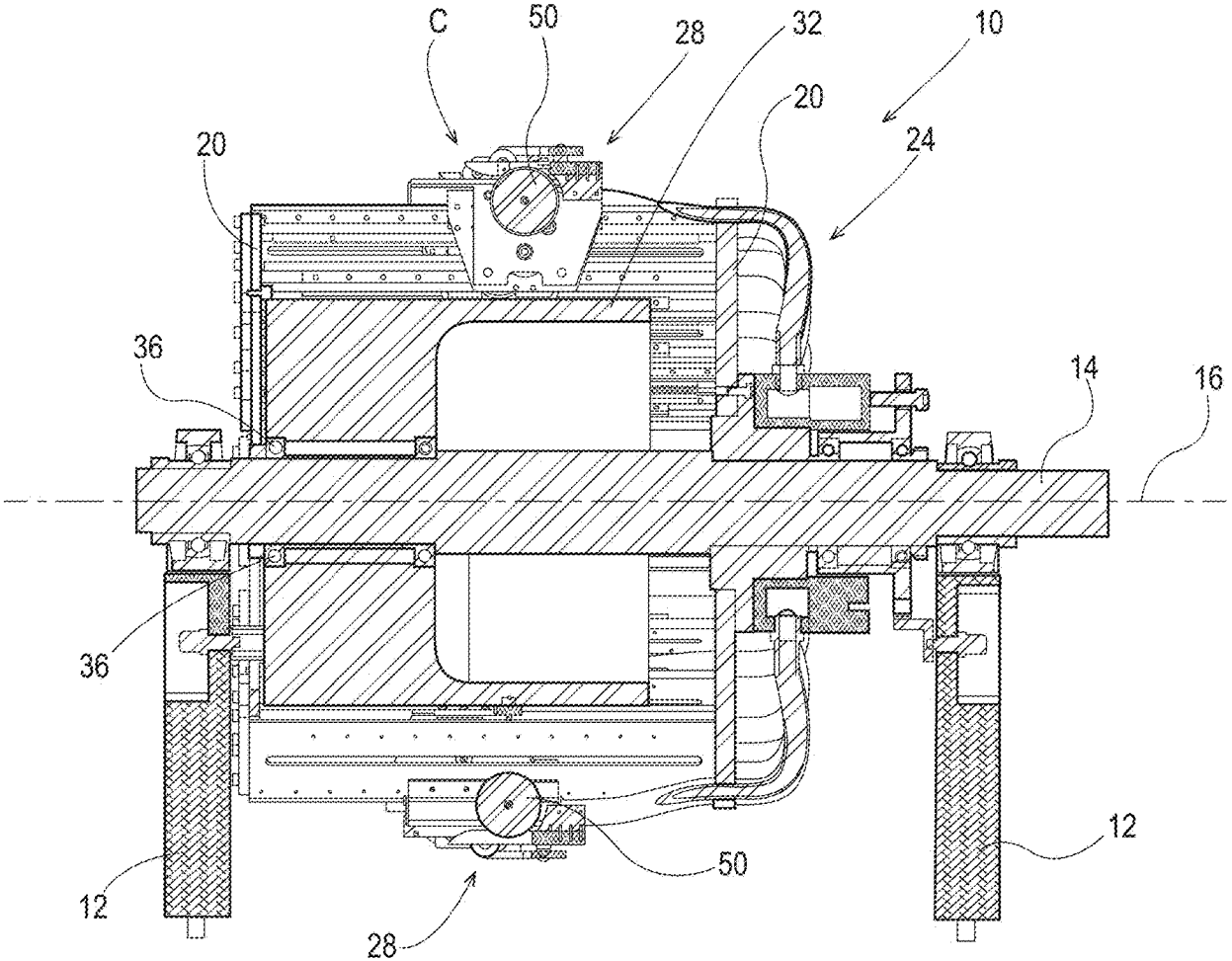
FIG. 6 is a cross-sectional view taken about line 6-6 of FIG. 3 in accordance with a non-limiting embodiment of the present disclosure.
Figure 7:
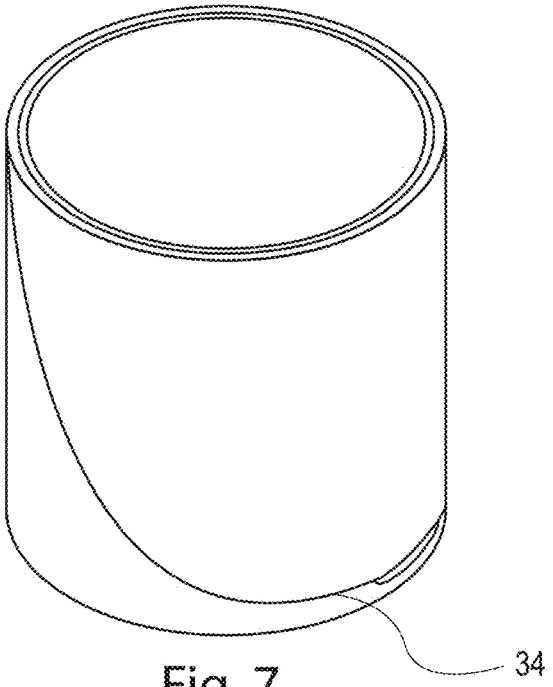
FIG. 7 is a perspective view of a barrel cam comprising a track for use with the cutting apparatuses in accordance with a non-limiting embodiment of the present disclosure.

The transfer heads 26 may each comprise a transfer surface defining one or more fluid ports 27 therein. The transfer surfaces are portions of the transfer heads 26 that contact and convey the strip of substrates and the articles (post-cutting). The fluid ports 27 may be arranged in any suitable pattern. The fluid ports 27 allow a fluid pressure (positive or negative) generated by the fluid movement system 24 to be applied to portions of a strip of substrate or to one or more articles or consumer products, or portions thereof, positioned on the transfer surfaces. Prior to cutting, portions of the strip of substrate extends between the transfer heads 26 so that cutting may occur intermediate the transfer heads 26. Referring to FIG. 5, the transfer heads 26 are each configured to engage a portion of the strip of substrate "S" on an incoming side of the cutting apparatus 10 using, for example, vacuum fluid pressure, and cause the strip of the substrate to rotate at least partially about the cutting apparatus 10 (e.g., from 3 o'clock to 9 o'clock). During such rotation, the strip of substrate is cut into individual portions or articles using the one or more cutting assemblies 28 of the cutting apparatus 10. The cut individual portions of the strip of the substrate or articles "A" are retained on the transfer heads 26 post-cutting again using a vacuum fluid pressure provided by the fluid management system 24. The cut articles "A" may then be discharged from the cutting apparatus 10 onto a conveyor 30 or other moving device for further processing and/or packaging. At least some of the fluid ports 27 of a transfer head 26 may be provided with a positive fluid pressure when they rotate past the discharge point of the cutting apparatus 10 to cause the articles to be separated from the transfer heads 26.

As discussed above, the fluid movement system 24 may be used to provide fluid flow to portions of, or all of, one or more of the fluid ports 27 in the transfer heads 26. The fluid movement system 24 may provide a positive fluid pressure and/or a negative fluid pressure to portions of, or all of, the one or more transfer heads 26 using fluid movement devices, such as fluid pumps (not illustrated). Fluid pumps are generally known to those of skill in the art and will not be discussed herein for brevity. In an embodiment, the fluid movement system 24 may provide a positive fluid pressure to some of the transfer heads 26, or portions thereof, for "blow off" of the cut articles positioned thereon and may provide a negative fluid pressure to some other transfer heads 26, or portions thereof, to maintain the articles or the strip of the substrate on the transfer heads 26. In some embodiments, the fluid movement system 24 may provide a positive fluid pressure to certain fluid ports 27 in a particular transfer head 26 and may provide a negative fluid pressure to other certain fluid ports 27 in the same transfer head 26 at a discharge point of the rotation of the cutting apparatus 10. As an example, a trailing portion (trailing with respect to the rotation of the transfer head) of a transfer head 26 may receive a negative fluid pressure from the fluid movement system 24, while a leading portion (leading with respect to the rotation of the transfer head) of the same transfer head 26 may receive a positive fluid pressure from the fluid movement system 24. This may be useful when the cut article on the transfer head 26 is being transferred off of the cutting assembly 10 or discharged because control of the trailing portion of article may be maintained while the leading portion of the article is blown off of the transfer head 26. After the leading portion of the article is blown off, fluid ports in the trailing portion of the transfer head 26 may then receive a positive fluid pressure from the fluid movement system 24 to aid in full article transfer. Such fluid movement system features in combination with transfer heads may provide for higher speed and more reliable article transfer. Example fluid movement systems in combination with transfer heads are disclosed in U.S. patent application Ser.

No. 13/447,568, entitled FLUID SYSTEMS AND METHODS FOR TRANSFERRING DISCRETE ARTICLES.

In an embodiment, referring to FIGS. 1-7, the cutting apparatus 10 may comprise a barrel cam 32. The barrel cam 32 is illustrated separate from the cutting apparatus 10 in FIG. 7. The barrel cam 32 may be positioned intermediate, or at least partially intermediate, the drive shaft 14 and a portion of the drum 22 comprising the transfer heads 26. The barrel cam 32 may also be positioned at least partially intermediate the rotating plates 20. The barrel cam 32 may be fixed with respect to the drum 22 and the drive shaft 14, such that the drum 22 and the drive shaft 14 may rotate relative to the fixed barrel cam 32. Stated another way, the barrel cam 32 does not rotate about the longitudinal axis 16. Bearings 36, or other members, may be provided to allow the drum 22 to rotate relative to the barrel cam 32. The barrel cam 32 may comprise a track 34 that forms a path that surrounds the longitudinal axis 16. The track 34 is configured to receive one or more cam followers 48, or portions thereof, that are engaged with one or more of the cutting assemblies 28. The track 34 may have any suitable cross-sectional shape configured to receive any suitable cam follower, such as a roller or a slidable member. Example cross-sectional shapes include generally square, rectangular, and/or arcuate, for example. All of these example cross-sectional shapes may have an open top portion such that the track 34 may be engaged by the one or more cam followers 48. The track 34 may comprise a single closed cam track or may comprise a conjugated cam track. The cam follower 48 is configured to move about the path of the track 34 as the drum 22 and the drive shaft 14 rotate relative to the longitudinal axis 16. The barrel cam 32 is configured to move portions of the one or more cutting assemblies 28 comprising a cutting device 50 or blade and other portions that move relative to a support member 42 ("carriage" (labeled as "C") in a direction parallel to, substantially parallel to, or transverse to the longitudinal axis 16 as the drum 22, the drive shaft 14, and the one or more cutting assemblies 28 rotate or orbit about the longitudinal axis 16. The movement of the one or more carriages of the cutting assemblies is illustrated at least in FIGS. 1 and 5. The carriages may move reciprocally in directions parallel to, substantially parallel to (i.e., +/−40 or 30 degrees from the longitudinal axis 16), or transverse to the longitudinal axis 16. The cutting device 50 may be configured to cut the strip of the substrate "S" while traversing the drum 22 generally in the cross-direction or in the cross-direction. The details of the cutting assemblies 28 will be described in further detail below.

Figure 8:
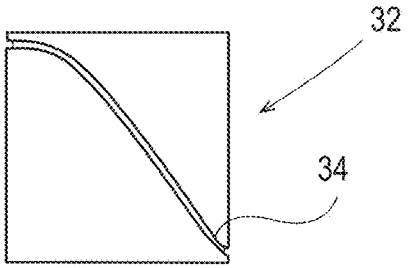
FIG. 8 is a front view of the barrel cam of FIG. 7 comprising the track in accordance with a non-limiting embodiment.
Figure 9:
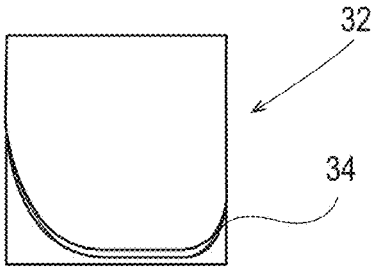
FIG. 9 is a side view of the barrel cam of FIG. 7 comprising the track in accordance with a non-limiting embodiment.
Figure 10:
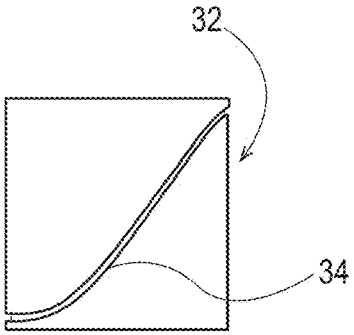
FIG. 10 is a rear view of the barrel cam of FIG. 7 comprising the track in accordance with a non-limiting embodiment.
Figure 11:
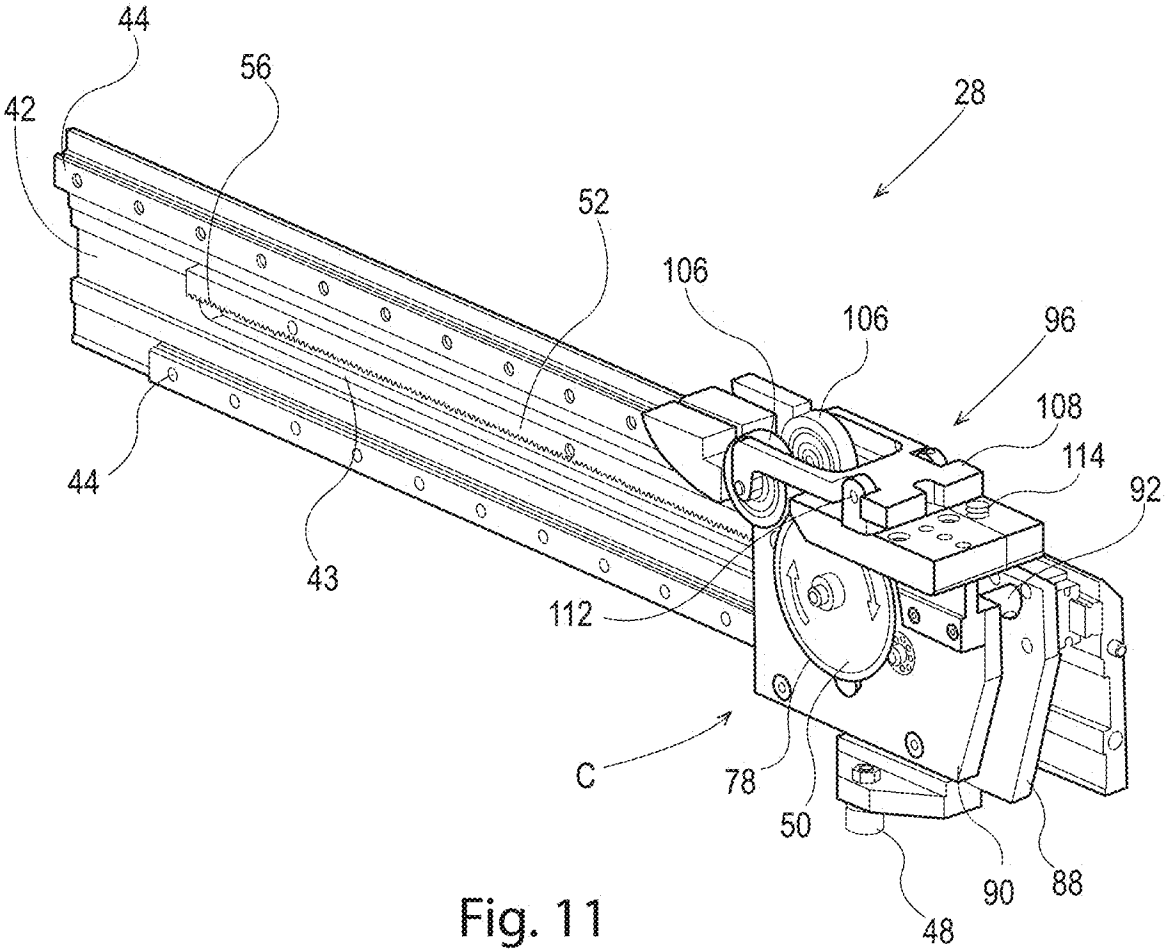
FIG. 11 is a top perspective view of a cutting assembly in accordance with a non-limiting embodiment of the present disclosure.
Figure 12:
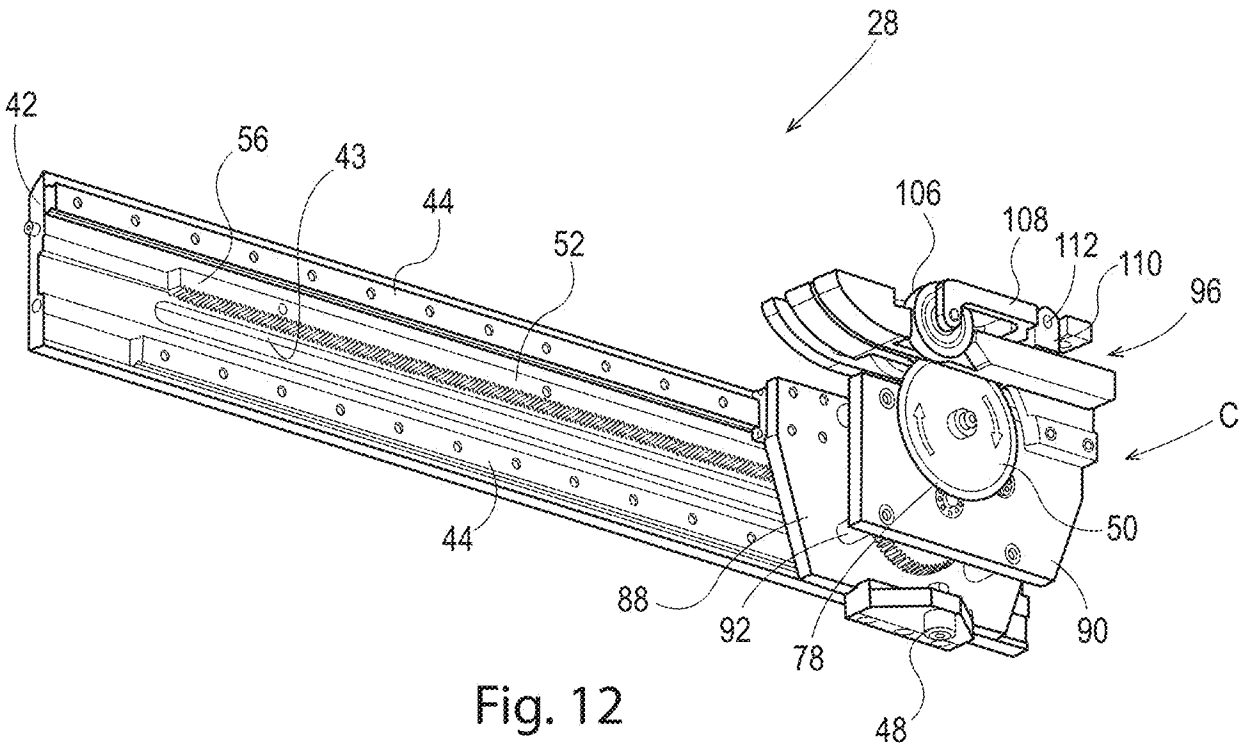
FIG. 12 is a bottom perspective view of the cutting assembly of FIG. 11 in accordance with a non-limiting embodiment of the present disclosure.
Figure 13:
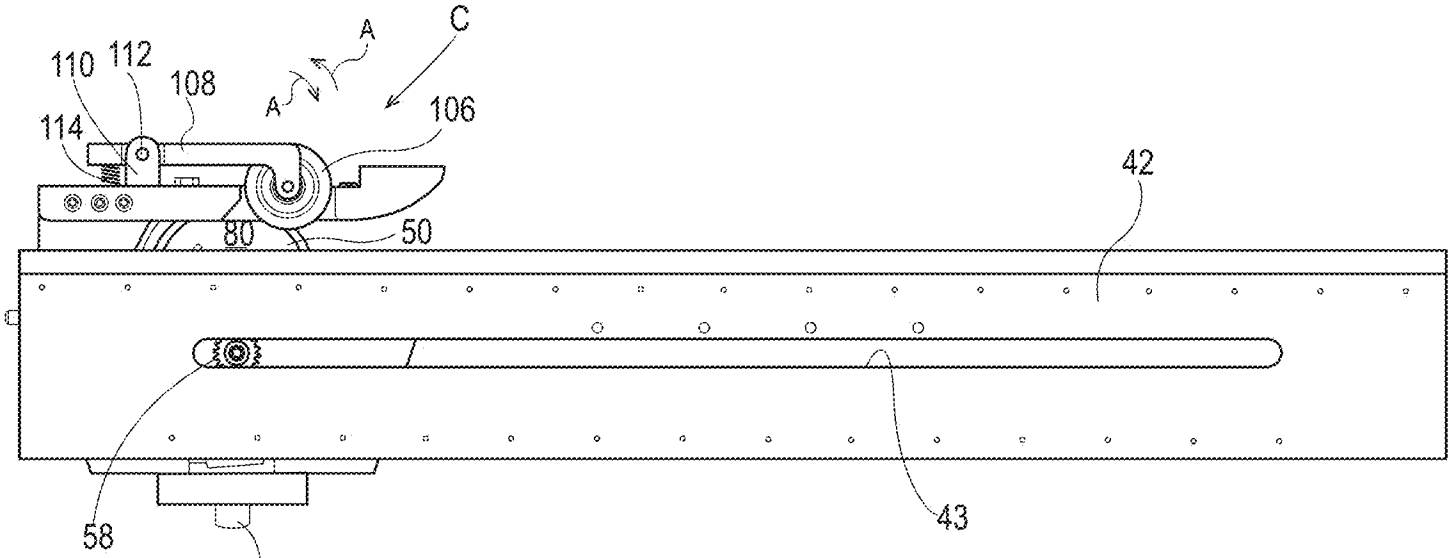
FIG. 13 is left side view of the cutting assembly of FIG. 11 in accordance with a non-limiting embodiment of the present disclosure.
Figure 14:
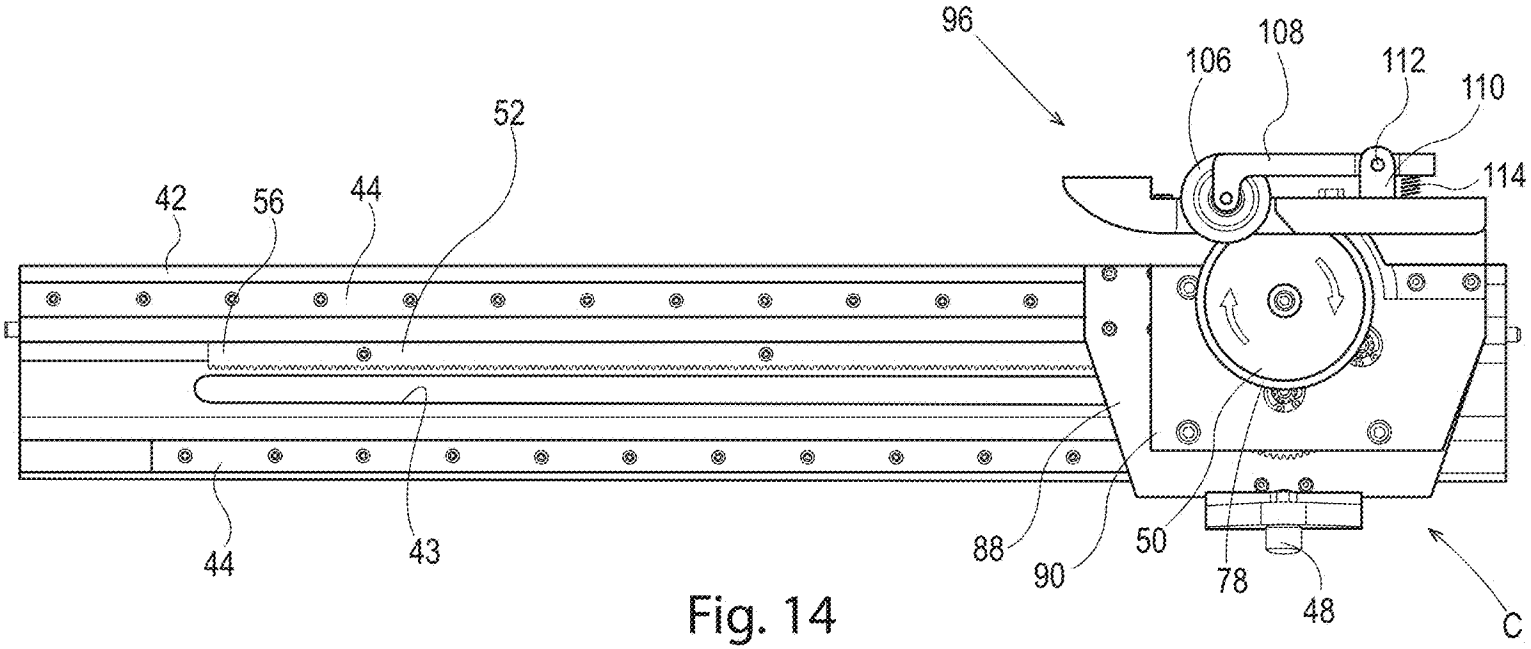
FIG. 14 is a right side view of the cutting assembly of FIG. 11 in accordance with a non-limiting embodiment of the present disclosure.

FIGS. 7-10 illustrate the barrel cam 32 comprising the track 34. FIG. 8 is a front view of the barrel cam 32, FIG. 9 is a side view of the barrel cam 32, and FIG. 10 is a rear view of the barrel cam 32. Those of skill in the art will understand how the cam follower 48 engages the track 34 and reciprocates the carriage.

In another embodiment, the barrel cam 32 and the cam follower 48 may not be provided and instead an actuator, such as a linear actuator, may be used to reciprocate the carriage generally across (generally in the direction of the longitudinal axis 16) the drum 22 such that the cutting device 50 may cut the strip of the substrate as the strip of substrate is rotated by the drum 22. The actuator may be a piston-type assembly comprising a housing and a piston that is operably engaged with a portion of the carriage such that the piston may reciprocate the carriage in directions generally along the longitudinal axis 16 when expanded and retracted relative to the housing using pneumatics or hydraulics, for example.

In an embodiment, referring to FIGS. 1-6, one or more of the cutting assemblies 28 may be provided on or joined to a portion of the drum 22 such that the cutting assemblies 28 rotate with the drum 22 when the drum 22 orbits about the longitudinal axis 16. The cutting assemblies 28 are positioned on a portion of the drum 22 such that the cutting devices 50 each traverse the drum 22 at a location at least partially intermediate a first transfer head 26 and a second transfer head 26. This allows the strip of substrate to be cut intermediate the first and second transfer heads 26 (and other pairs of transfer heads) and for a portion of the carriage to move through a gap formed intermediate two of the transfer heads 26.

In an embodiment, the cutting assemblies 28 may each comprise a support member 42 that is configured to be engaged with portions of the drum 22 and/or to the rotating plates 20 to attach the cutting assemblies 28 to the drum 22 and cause them to rotate with the drum 22. The cutting assemblies 28 are configured to move in directions parallel to, substantially parallel to, or transverse to the longitudinal axis 16 as the drum 22 orbits about the longitudinal axis 16. In various embodiments, each of the cutting assemblies 28 may be the same or different on the cutting apparatus 10. Referring generally to FIGS. 1 and 11-17, the support member 42 may be linear, non-linear, and/or may comprise an arcuate portion depending on the desired cutting path for the cutting device 50 or blade. The support member 42 may comprise a slot 43 defined therein. A portion of a drive shaft of a compounding gear assembly may extend through the slot 43 to aid engagement with a rack. The support member 42 may comprise, be formed with, or be attached to one or more guides 44, such as linear guides 44. The guides 44 may follow the shape of the support member 42 (e.g., be linear, non-linear, and/or comprise an arcuate portion or may have other shapes). The guides 44 may each comprise one or more tracks 38 upon which a guide engaging member 46 can slide, move, and/or reciprocate. In an embodiment, the guide engaging member 46 may have one or more projections 40 extending therefrom and configured to slidably engage the tracks 38. In an embodiment, the guides may instead be a slot in the support member 42 and the guide engaging member may be a projection that is slidable within the slot. Any other suitable method of engaging the guides 44 with the guide engaging member 46 known to those of skill in the art are within the scope of the present disclosure. One aspect of the guides is that relative motion can be achieved between the one or more guides 44 and the one or more guide engaging members 46.

In an embodiment, each of the cam followers 48 of the cutting assembly 28 is configured to be at least partially engaged with the track 34 in the barrel cam 32. The cam followers 48 may be mounted at any suitable location on the carriage. The cam followers 48 may each comprise one or more rollers or low coefficient of friction materials of suitable shapes to engage the track 34, for example. In one embodiment, the cam followers 48 may comprise a roller or other member that is coated with a low coefficient of friction material. Owing to the engagement of the cam followers 48 and the track 34, the portion of the cutting assembly comprising a cutting device 50 (e.g., the carriage) may reciprocate at least partially about the support member 42 to cut the strip of substrate or other material.

The cutting assembly 28 may comprise a rack 52, such as a linear gear or a generally linear gear with a somewhat arcuate portion that can be formed with or attached to the support member 42. The rack 52 may be linear or non-linear (e.g., comprises an arcuate portion) depending on the desired cutting path of the cutting member 50 and possibly depending on whether the one or more guides 44 and the support member 42 are linear or non-linear. The rack 52 may comprise a plurality of teeth configured to meshingly engage the teeth of another gear. The rack 52 may be mounted intermediate two of the guides 44 or at another location on the support member 42. The rack 52 may comprise a first end 54 and a second end 56. The rack 52, the support member 42, and/or the guides 44 may be positioned parallel to the longitudinal axis 16, substantially perpendicular to the longitudinal axis 16 (e.g., +/−30 degrees, 20 degrees, 10 degrees, 5 degrees, 3 degrees, 2 degrees, or 1 degree from the longitudinal axis 16), or transverse to the longitudinal axis 16.

Figure 18:
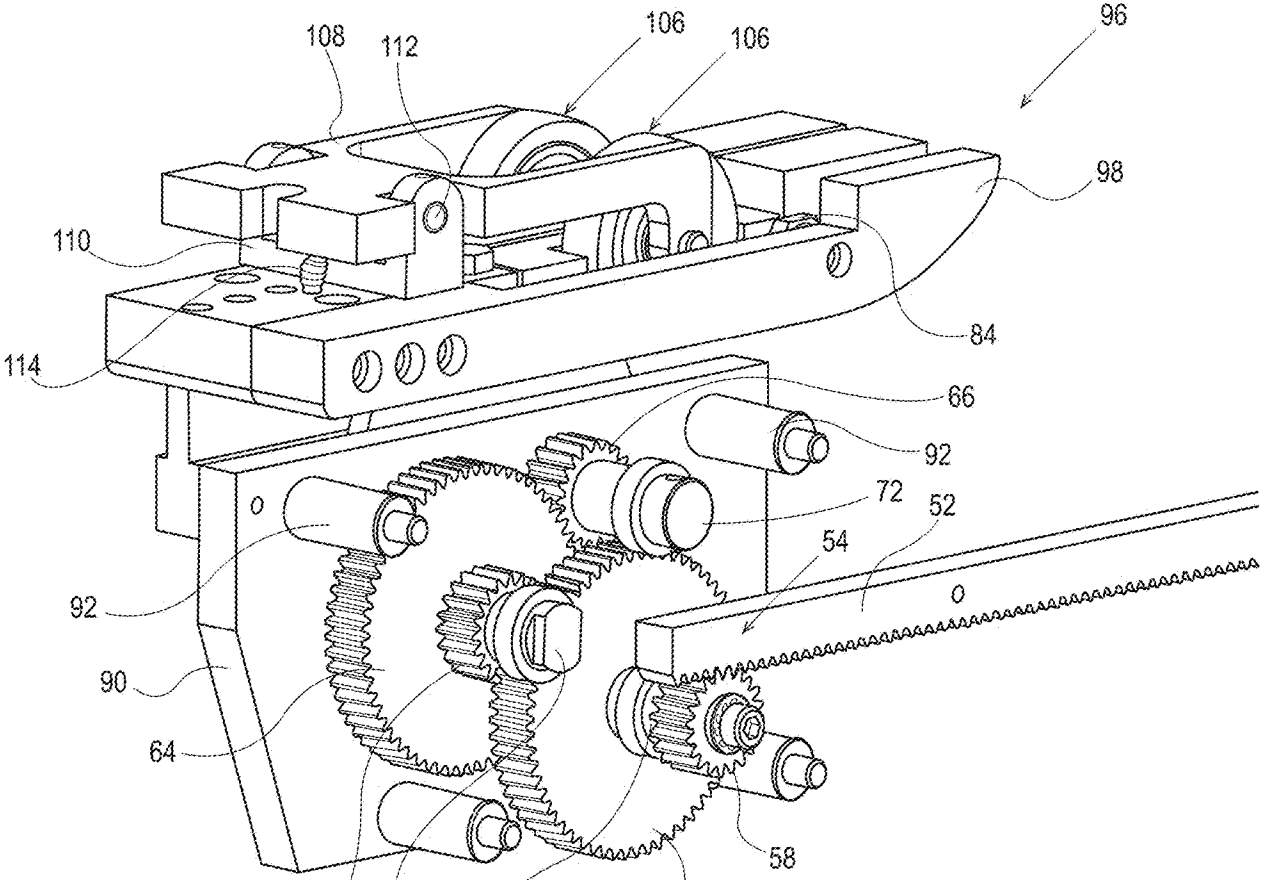
FIG. 18 is a perspective view of a portion of a carriage of the cutting assembly engaged with a rack in accordance with a non-limiting embodiment of the present disclosure.

In an embodiment, the rack 52 may operably engaged with a portion of a rotary speed changing assembly, such as a single gear, or a compounding gear assembly 57, for example. The compounding gear assembly 57 may comprise a plurality of gears comprising a first gear 58 operably engaged with the rack 52, wherein the first gear is configured to travel at least partially intermediate the first end 54 and the second end 56 of the rack 52. Referring to FIG. 18, the compounding gear assembly 57, in one example form, may comprise a first gear 58, a second gear 60, a third gear 62, a fourth gear 64, and a fifth gear 66. At least one gear, and any suitable number of gears may be provided in the compounding gear assembly 57 such that the rotational speed of the cutting device 50 is at least three times faster, at least five times faster, or at least 10 times faster than the rotational speed of the first gear 58. Other suitable speed increasing or changing assemblies known to those of skill in the art are also within the scope of the present disclosure and can be used instead of the example compounding gear assembly 57 discussed and illustrated herein. In an embodiment, the first gear 58 may be forced to travel along the rack 52 at least partially intermediate the first end 54 and the second end 56 of the rack 52 as the carriage is reciprocated at least partially along the length of the support member 42 by the cam follower's engagement with the track 34 of the barrel cam 32. In other instances, the first gear 58 may be moved about the rack 52 at least partially intermediate the first end 54 and the second end 56 when the actuator or linear actuator discussed above reciprocates the carriage at least partially about the length of the support member 42.

In an embodiment, the at least one first gear 58, when meshingly engaged with the rack 52 and reciprocated at least partially intermediate the first and second ends 54, 56 of the rack 52, causes the second gear 60 to rotate and the cutting device 50 to directly or indirectly rotate. The first gear 58 and the second gear 60 are both non-rotatably fixed to a first drive shaft 68. As the first gear 58 is reciprocated along at least a portion of the rack 52, thereby rotating the first gear 58, the first drive shaft 68 is rotated, thereby causing the second gear 60 to rotate. The second gear 60 is meshingly engaged with the third gear 62 and causes the third gear 62 to rotate when the second gear 60 is rotated. The third gear 62 and the fourth gear 64 are non-rotatably fixed to a second drive shaft 70. As the third gear 62 is rotated by the second gear 60, the fourth gear 64 is rotated owing to its fixed relationship to the second drive shaft 70. The fourth gear 64 is meshingly engaged with the fifth gear 66. As a result, when the fourth gear 64 is rotated, the fifth gear 66 rotates. The fifth gear 66 is non-rotatably fixed to a third drive shaft 72. The third drive shaft 72 is also non-rotatably fixed to the cutting device 50 (either directly or indirectly). As a result, when the fifth gear 66 is rotated by the fourth gear 64, the cutting device 50 is rotated or driven in the direction indicated by the arrows in FIGS. 11, 12, and 14. In an embodiment, the cutting device 50 is rotated in the same direction (i.e., clockwise or counterclockwise) as the first gear 58. In other embodiments, the cutting device 50 may be rotated in a different direction as the first gear 58 depending on the configuration of the speed increasing/changing assembly. Any of the gears or the cutting device 50 may be non-rotatably fixed to the various drive shafts using any methods or apparatuses known to those of skill in the art. The gears may be non-rotatably fixed to the drive shafts either directly or indirectly, as recognized by those of skill in the art. The various drive shafts 68, 70, and 72 may include spacers 74 positioned thereon that provide proper alignment of the various gears. In an embodiment, the first gear 58 may travel from the first end 54 of the rack 52 to the second end 56 of the rack 52 and back to the first end 54 in one full rotation of the drum 22 about the longitudinal axis 16. In another embodiment, the first gear 58 may travel intermediate the first end 54 of the rack 52 and the second end 56 of the rack 52 and back to the first end 54 in one full rotation of the drum 22 about the longitudinal axis 16. The illustrated compounding gear assembly 57 is only one example type of rotary speed changing or increasing assembly that may be used with the present disclosure. Those of skill in the art will recognize that other speed changing or increasing assemblies and/or other compounding gear assemblies may be used.

The rotational speed of the cutting device 50 may be at least 5 times faster, at least 10 times faster, at least 15 times faster, at least 20 times faster, about 5 to about 40 times faster, about 8 to about 25 times faster, about 8 to about 20 times faster, or about 8 to about 15 times faster, specifically reciting all 0.1 increments within the above-referenced ranges and all ranges formed therein or thereby, than the rotational speed of the first gear 58 owing to the compounding gear assembly 57. The rotational speed of the cutting device 50 may be at least 800 revolutions per minute, at least 1,000 revolutions per minute, at least 1,250 revolutions per minute, at least 1,500 revolutions per minute, at least 1,750 revolutions per minute, at least 2,000 revolutions per minute, or in the range of about 750 revolutions per minute to about 3,500 revolutions per minute, about 1,000 revolutions per minute to about 3,000 revolutions per minute, about 1,500 revolutions per minute to about 3,000 revolutions per minute, about 2,000 revolutions per minute to about 3,000 revolutions per minute, owing to the compounding gear assembly 57, specifically reciting all 1 revolution per minute increments within the specified ranges and all ranges formed therein or thereby. The rotational speed of the cutting device 50 may be proportional to the path of the track 34 in the barrel cam 32 owing to the cam follower's 48 engagement with the track 34. Alternatively, the rotational speed of the cutting device 50 may be proportional to how quickly the actuator or the linear actuator moves the carriage relative to the support member 42 or the rack 52. The rotational speed of the cutting device 50 may be varied by changing the path of the track 34 in the barrel cam 32 or by changing the compounding gear assembly 57 (e.g., using smaller or larger gears in one or more of the gears). Alternatively, the rotational speed of the cutting device 50 may be varied by changing the speed of the actuator or the linear actuator moving the carriage.

In an embodiment, the rotational speed of the cutting device 50 may vary along the length of the rack 52 or along the length of the rack 52 where the carriage is being reciprocated (i.e., vary along the path of the carriage). The rotational speed of the cutting device 50 may increase until the cutting device 50 is at a position relative to the support member 42 where it will engage an article to be cut, then the rotational speed may remain constant or substantially constant (e.g., +/−20 revolutions per minute) during cutting, and then the rotational speed may decrease post-cutting. In other embodiments, the rotational speed of the cutting device 50 may be constant or variable during cutting and/or pre and/or post cutting. In still another embodiment, the rotational speed may be constant or substantially constant throughout a full stroke of the cutting device 50.

Instead of using the first gear 58 and the rack 52 to drive the compounding gear assembly 57 and thereby the cutting device 50, an actuator, such as a motor 55, for example, may be used instead. The motor 55 may be operably engaged with a drive shaft. The drive shaft may be engaged with the cutting device 50 directly such that the rotation of the drive shaft rotates the cutting device 50 (1:1 rotational speed ratio between the drive shaft of the motor 55 and the cutting device 50). In other embodiments, the actuator may be operably engaged with a drive shaft (such as drive shaft 68) of the compounding gear assembly 57 or other speed increasing or changing assembly such that one rotation of the drive shaft (e.g., 68) causes the cutting device 50 to rotate at least 5 times, at least 10 times, or even at least 15 times, for example. In such an embodiment, the first gear 58 may not be provided and the actuator may be directly or indirectly operably engaged with the drive shaft 68 or other drive shaft to drive the compounding gear assembly 57 and thereby the cutting device 50. In still other embodiments, the first gear 58 may be driven directly or indirectly by the actuator.

Figure 19:
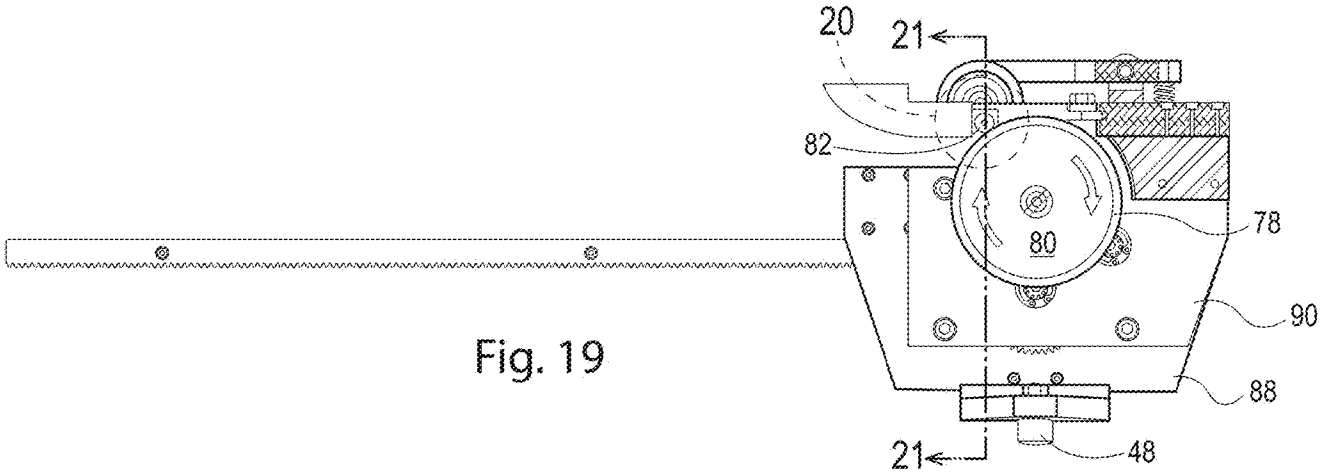
FIG. 19 is a side view of a portion of a carriage of the cutting assembly engaged with a rack in accordance with a non-limiting embodiment of the present disclosure.
Figure 22:
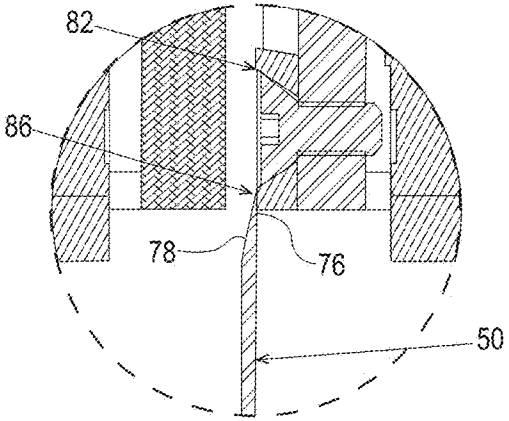
FIG. 22 is a detail view taken from detail 22 of FIG. 21 in accordance with a non-limiting embodiment of the present disclosure.
Figure 21:
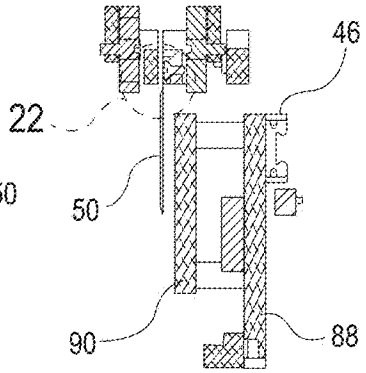
FIG. 21 is a cross-sectional view taken from line 21-21 of FIG. 19 in accordance with a non-limiting embodiment of the present disclosure.
Figure 20:
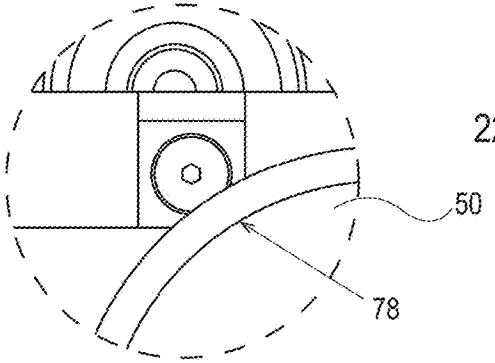
FIG. 20 is a detail view taken from detail 20 of FIG. 19 in accordance with a non-limiting embodiment of the present disclosure.

The cutting device 50 may comprise a blade, such as a hardened steel blade. The blade may also comprise other material suitable for cutting as will be recognized by those of skill in the art. The blade may be circular or non-circular and may or may not be faceted. The blade may have a Rockwell C scale hardness of about 40 to about 70 or about 50 to about 60, specifically reciting all whole integers within the specified ranges and all ranges formed therein or thereby. Referring to FIG. 19, a carriage is illustrated on the rack 52 with the support member 42 and the one or more guides 44 removed for illustration. FIG. 20 is a detailed view taken from detail 20 of FIG. 19. FIG. 21 is a cross-sectional view taken from line 21-21 of FIG. 19. FIG. 22 is a detailed view taken from detail 22 of FIG. 21. Referring to FIGS. 19-22, the cutting device 50 may comprise an edge portion 76 and an opposing edge portion 78. The edge portion 76 may be flat or substantially flat and the opposing edge portion 78 may be beveled. The bevel may have an angle relative to a flat planer surface 80 of the cutting device 50 of about 3 degrees to about 70 degrees, of about 3 degrees to about 60 degrees, of about 5 degrees to about 50 degrees, of about 5 degrees to about 40 degrees, of about 5 degrees to about 30 degrees, of about 5 degrees to about 25 degrees, of about 5 degrees to about 20 degrees, of about 8 degrees to about 18 degrees, of about 10 degrees to about 20 degrees, or about 15 degrees, specifically reciting all 0.1 degree increments within the above-specified ranges and all ranges formed therein or thereby. The edge portion having the bevel may face away from the support member 42 or towards the support member 42. In other embodiments, the edge portion 76 may be beveled while the opposing edge portion 78 may be flat or substantially flat. In other embodiments, both of the edge portions 76, 78 may be beveled, flat, or substantially flat. Other configurations of the cutting device will be known or apparent to those of skill in the art. Those configurations are also within the scope of the present disclosure.

Figure 15:
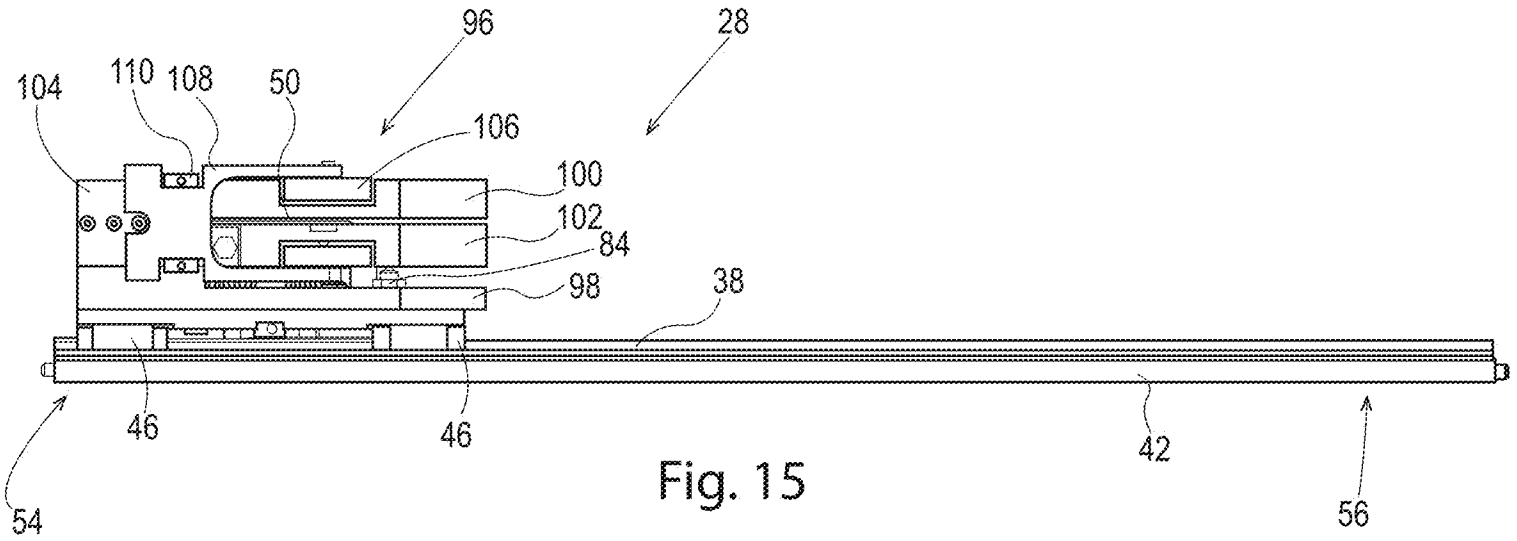
FIG. 15 is a top view of the cutting assembly of FIG. 11 in accordance with a non-limiting embodiment of the present disclosure.
Figure 16:
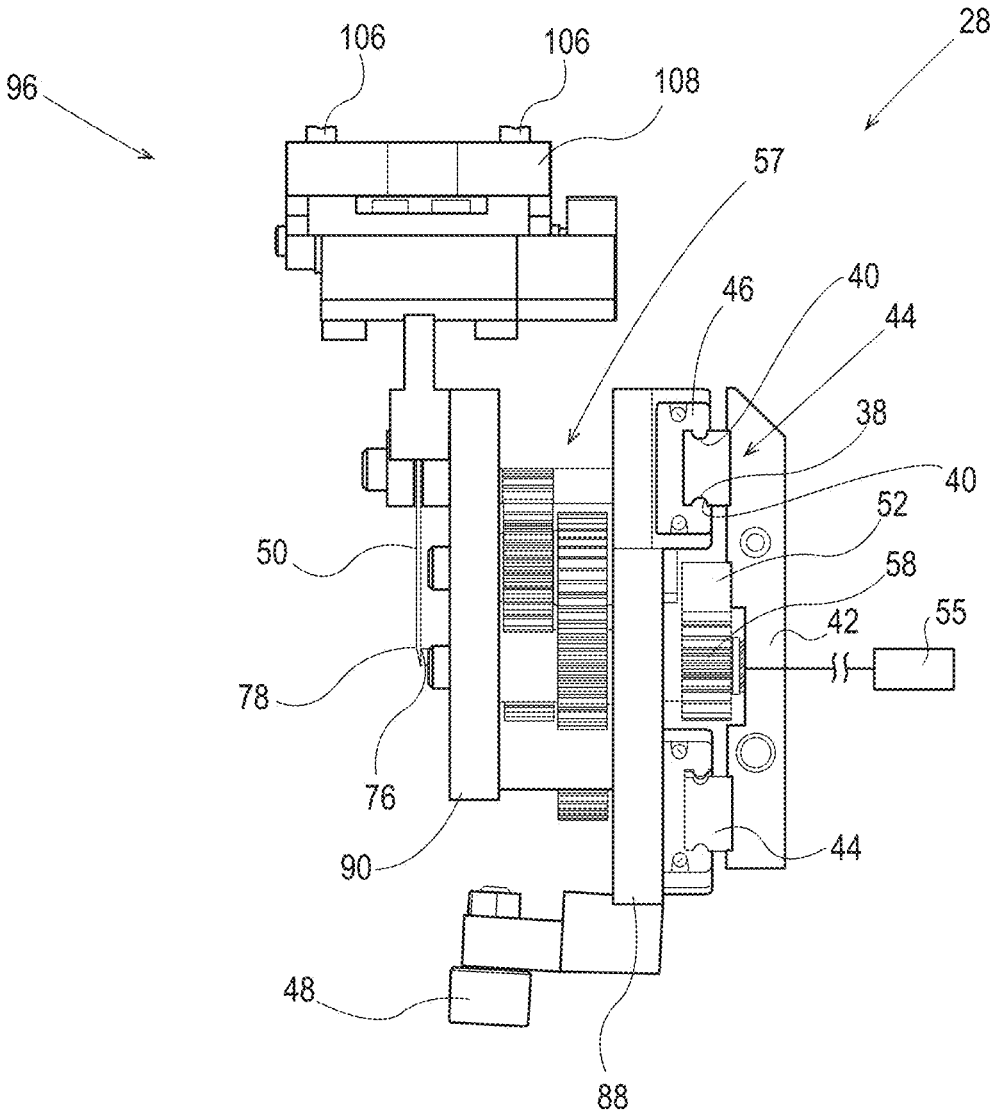
FIG. 16 is a rear end view of the cutting assembly of FIG. 11 in accordance with a non-limiting embodiment of the present disclosure and schematically showing a motor, the schematic motor not being illustrated in the remaining views.
Figure 17:
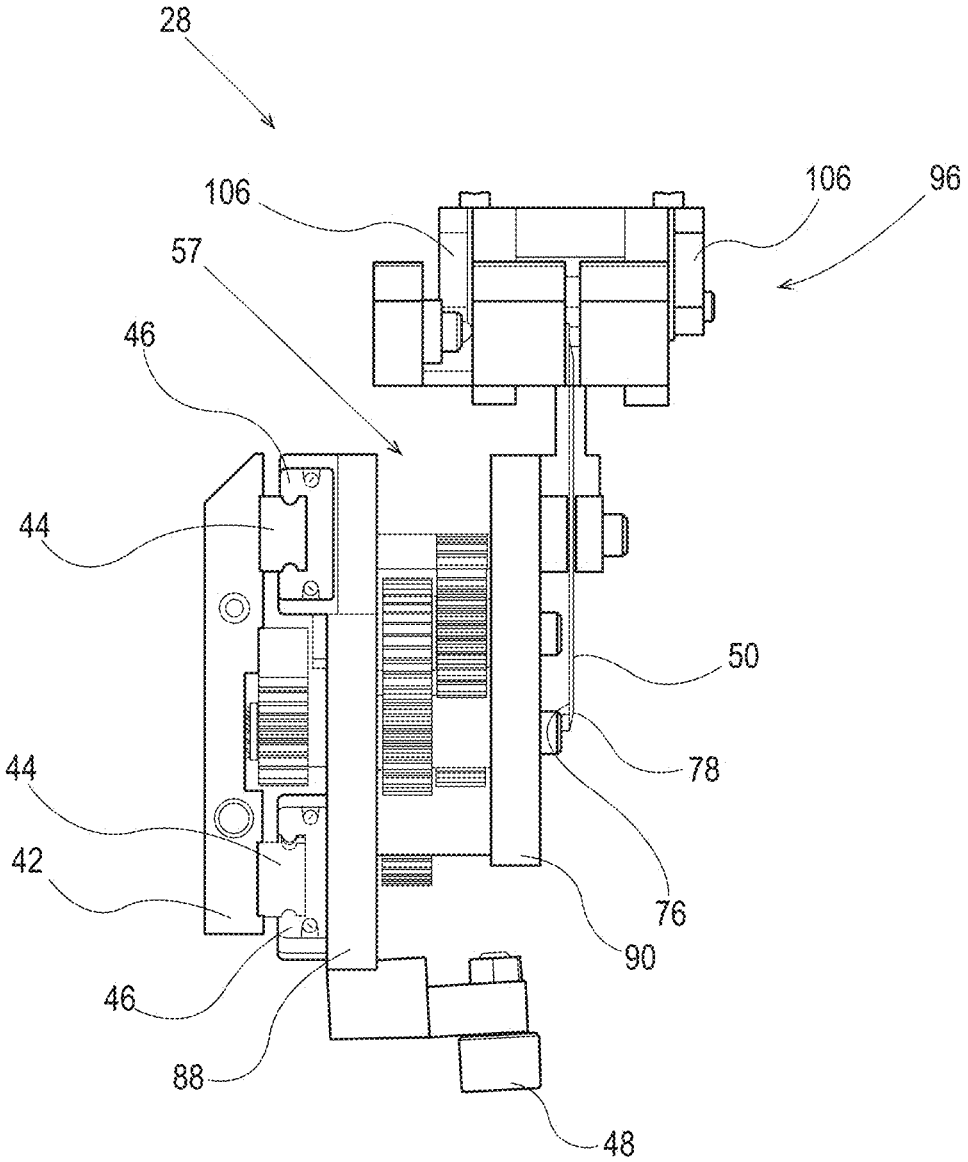
FIG. 17 is a front end view of the cutting assembly of FIG. 11 in accordance with a non-limiting embodiment of the present disclosure.

In an embodiment, again referring to FIGS. 19-22, the cutting assembly 28 may comprise a cutting device-contacting member 82. The cutting-device contacting member 82 may be attached to a portion of the carriage such that it can engage an edge portion of the cutting device 50 or other portion of the cutting device 50. The cutting device-contacting member 82 may comprise a carbide chip or insert. One suitable chip or insert is a KC725M grade carbide milling insert available from Kennametal®. At least a portion of, or all of, the cutting device-contacting member 82 may be biased toward a portion of the edge portion 76 of the cutting device 50, as illustrated in FIGS. 20-22, using a biasing member, such as one or more springs 84, for example. The spring 84 is also illustrated in FIG. 15. In another embodiment, the cutting device 50 may be biased toward the cutting device-contacting member 82 or the cutting device 50 and the cutting device-contacting member 82 may each be biased toward each other. In an embodiment, the biasing force may be in the range of about 0.3 kg to about 2.0 kg or about 0.5 kg to about 1.5 kg, specifically reciting all 0.1 increments within the specified ranges and all ranges formed therein or thereby. The portion of the cutting device-contacting member 82 that is biased toward a portion of the edge portion 76 or the edge portion 78 may create a nip 86 between the portion of the cutting device-contacting member 82 and the portion of the edge portion 76 or 78. In use, a piece of material is essentially sucked or pulled into the nip 86 and cut or sheared within the nip 86 by the cutting device 50. The cutting device 50 may form an in running nip at the point where the edge portion 76 contacts or intersects with the cutting device-contacting member 82. This in running nip may pull all of the fibers or other materials being cut into the intersection of the edge portion 76 and the cutting device-retaining member 82 so as to allow the cutting device 50 to shear through the fibers or other materials being cut. The cutting device-contacting member 82 may have a Rockwell C scale hardness in the range of about 70 to about 100 or about 80 to about 90, specifically reciting all whole integer increments within the specified ranges and all ranges formed therein or thereby. Therefore, the cutting device-contacting member 82 may be harder than the cutting device 50. As a result, the cutting device-contacting member 82 may sharpen the edge portion 76 during rotation of the cutting device 50 of the cutting device 50. If the cutting device-contacting member 82 is biased against the edge portion 78 it may also sharpen the edge portion 78 during rotation of the cutting device 50. This sharpening can significantly increase the life of the cutting device 50 or blade. In an embodiment, a second cutting device-contacting member (not illustrated) may be biased toward the edge portion 78 in addition to the cutting device-contacting member 82 so as to form two nips.

In an embodiment, referring to FIGS. 11-18, the carriage may comprise a first plate 88 and a second plate 90. The first plate 88 may be positioned most proximal to the support member 42 and the second plate 90 may be positioned most distal from support member 42. The first and second plates 88 and 90 may have any suitable size and shape and be comprised of any suitable material or materials. At least a portion of the compounding gear assembly 57 may be positioned at least partially intermediate the first plate 88 and the second plate 90. The first and second plates 88 and 90 may be spaced apart from each other using spacers 92 or any other suitable members. The cutting member 50 may be positioned on the side of the second plate 90 most distal from the support member 42 or may be otherwise positioned. The one or more guide engaging members 46 may be joined to or formed with the first plate 88. The cam follower 48 may be attached to either plate 88 or 90.

A sled 96 may extend from or be attached to the second plate 90 or the first plate 88. The sled 96 may comprise a first bar 98, a second bar 100, and a third bar 102 disposed at least partially intermediate the first and second bars 98 and 100. The first and second bars 98 and 100 may be a unitary structure or two or more structures joined together. The third bar 102 may be biased towards the second bar 100 using a spring 84 or other biasing device. Alternatively, the cutting device 50 may be biased toward the third bar 102. The third bar 102 may comprise the cutting device-contacting member 82 or the cutting device contacting member 82 may be attached to the third bar 102 using any suitable attachment techniques. A cutting device-contacting member may also be positioned on the first bar 98 or on the second bar 100 depending on a desired configuration and what edge portions of the cutting device 50 should be contacted by a portion of a cutting device-contacting member.

In an embodiment, the sled 96 may also comprise one or more retaining members 106 configured to hold the strip of substrate to the transfer surfaces of the transfer heads 26 during cutting or shearing. Stated another way, the retaining members 106 may be aligned with the nip 86 or cutting point to essentially hold the strip of substrate while the cut takes place. Any suitable number of retaining members 106 may be provided. If two retaining members 106 are provided, a first retaining member 106 may engage and move or roll over a first transfer surface of a first transfer head 26 and a second retaining member 106 may engage and move or roll over a second transfer surface of a second transfer head 26, while the cutting device 50 cuts the strip of substrate intermediate the first and second transfer heads 26. The retaining members 106 may comprise rollers comprising a plastic, a rubber, or other material. The retaining members 106 may instead comprise low coefficient of friction materials that can easy slide over portions of the strip of substrates. The retaining members 106 may be rotatably mounted or otherwise mounted to a support 108 positioned on a top portion of the sled 96 and biased toward a surface 104 of the sled 96. The support 108 may be pivotably attached to a projection 110 on the sled 96. The projection 110 may have a pin 112 extending from a first side of the projection 110 to a second side of the projection 110 or an aperture in the first side of the projection 110 to an aperture in the second side of the projection 110. The support 108 may pivot about the pin 112 in the directions indicated by arrows "A" in FIG. 13. As a result, the retaining members 106 may be pivotable with respect to the various bars 98, 100, and 102. The support 108 may be biased such that the retaining members 106 are biased toward the bars 98, 100, and 102 using one or more springs 114 or other biasing members. The springs 114 may extend from the surface 104 of the sled 96 to a surface of the support 108 to bias the retaining members 106 toward the bars 98, 100, and 102. The one or more springs 114 may provide a biasing force in the range of about 1 kg to about 6 kg or of about 2 kg to about 4 kg, specifically reciting all 0.1 kg increments within the specified ranges and all ranges formed therein or thereby. In an embodiment, the second bar 100 may define a recess into which a portion of a retaining member 106 may be positioned when biased by the spring 114. The third bar 102 may also define a recess into which a portion of a different retaining member 106 may be positioned when biased by the spring 114. The cutting device 50 may extend intermediate the second bar 100 and the third bar 102 or may extend through a slot in one of the bars or be otherwise positioned on the sled 96.

In one form, a method of cutting or shearing one or more tow fibers or layers thereof or other materials mentioned herein may comprise rotating a drum comprising a cutting assembly comprising a cutting device about a longitudinal axis of a drive shaft, reciprocally moving a portion of the cutting assembly comprising the cutting device in a direction parallel to or transverse to the longitudinal axis as the cutting assembly is rotated about the longitudinal axis, rotating the cutting device at least 1,000 times per minute, at least 1,500 times per minute, or at least 2,000 times per minute (or other speeds as disclosed herein), and cutting or shearing the tow fibers and/or other materials with the cutting device. The method may further comprise biasing a cutting device-contacting member against an edge portion of the cutting device during the cutting or shearing step. The method may further comprise using a nip created between a portion of the cutting device-contacting member and a portion of the edge portion of the cutting device to shear or cut the tow fibers and/or the other material. The method may further comprise sharpening the edge portion of the cutting device using the cutting device-contacting member during the rotating the cutting device step. The method may further comprise rotating the cutting device at a substantially constant rotational speed during the cutting or shearing step. The drum may comprise a transfer head and the cutting assembly may comprise a retaining member. The method may further comprise retaining the tow fibers and/or other materials to the transfer head during the cutting or shearing step using the retaining member. The method may further comprise rotating the cutting device at a first rotational speed while not cutting or shearing the tow fibers and/or other materials and rotating the cutting device at a second, different rotational speed while cutting or shearing the tow fibers or other materials. The second, different rotational speed may be greater than the first rotational speed or less than the first rotational speed.

In another form, a method of shearing or cutting a material, such as one or more nonwoven materials and/or one or more tow fibers or layers of tow fibers is provided. The method may comprise rotating a drum comprising a cutting assembly comprising a cutting device about a longitudinal axis of a drive shaft, reciprocally moving a portion of the cutting assembly comprising the cutting device in a direction parallel to, generally parallel to, or transverse to the longitudinal axis as the cutting assembly is rotated about the longitudinal axis, rotating the cutting device at least 1,000 revolutions per minute, at least 1,500 revolutions per minute, or at least 2,000 revolutions per minute (or other speeds disclosed herein), biasing a cutting device-contacting member against an edge portion of the cutting device, cutting or shearing the material in a nip created between a portion of the cutting device-contacting member and a portion of the edge portion of the cutting device. The cutting nor shearing the material step may comprise cutting or shearing one or more nonwoven materials and one or more tow fibers or layers of tow fibers. The edge portion of the cutting device may comprise a substantially flat portion and an opposing edge portion of the cutting device may comprise a beveled portion. The method may comprise sharpening the cutting device using the cutting-device contacting member. The method may comprise rotating the cutting device at a constant, substantially constant, or variable rotational speed during the cutting or shearing step. The drum may comprise a transfer head. The cutting assembly may comprise a retaining member. The method may comprise retaining the material to the transfer head during the cutting or shearing step using the retaining member. The method may comprise rotating the cutting device at a first rotational speed while not shearing or cutting the material and rotating the cutting device at a second, different rotational speed while shearing or cutting the material.

In another form, a method of cutting or shearing materials, such as one or more nonwovens and one or more tow fibers or layers of tow fibers, may comprise rotating a cutting device at least 1,000 times per minute, at least 1,500 times per minute, or at least 2,000 times per minute (or other speeds disclosed herein), biasing a cutting device-contacting member against an edge portion of the cutting device, and shearing or cutting the materials in a nip formed at least partially intermediate the cutting device and the cutting device-contacting member. The method may further comprise sharpening the edge portion of the cutting device using the cutting device-contacting member during the rotating step, and rotating the cutting device at a constant, substantially constant, or variable rotational speed during the shearing or cutting step.

In another form, a method of cutting or shearing materials, such as one or more nonwoven materials and one or more tow fibers or layers of tow fibers, may comprise rotating a cutting device at least 1,000 times per minute, at least 1,500 times per minute, or at least 2,000 times per minute (or other speeds disclosed herein) and cutting or shearing the materials.

In another form, a method of cutting or shearing a strip of dusters may comprise rotating a cutting device at least 1,000 times per minute, at least 1,500 times per minute, or at least 2,000 times per minute (or other speeds disclosed herein) and cutting or shearing the material.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, those of skill in the art will recognize that various other changes and modifications can be made without departing from the spirit and scope of the invention. It is therefore intended to cover in the appended claims all such changes and modifications that are within the scope of this invention.

What is claimed is:

1. A cutting apparatus comprising:

a drum configured to orbit about a longitudinal axis;

a barrel cam positioned at least partially intermediate the longitudinal axis and a portion of the drum, wherein the barrel cam comprises a track that forms a path that surrounds the longitudinal axis, and wherein the drum rotates relative to the barrel cam; and a cutting assembly joined to the drum and configured to orbit about the longitudinal axis with the drum, the cutting assembly comprising:

a rack comprising a first end and a second end, wherein the rack extends in a direction transverse to or parallel to the longitudinal axis between the first end and the second end;

at least one gear comprising a first gear operably engaged with the rack, wherein the first gear is configured to travel in a first direction at least partially intermediate the first end and the second end of the rack and back on a common path;

a cutting device driven by the at least one gear; a cam follower at least partially engaged with the track and configured to orbit about the longitudinal axis within the path of the track, wherein the cam follower is configured to move the first gear at least partially intermediate the first end and the second end of the rack when the cutting assembly is orbiting about the longitudinal axis to cause the cutting device to translate transverse to or parallel to the longitudinal axis, a carriage supporting the cutting device and cam follower, and a plurality of transfer heads circumferentially spaced apart on the drum, wherein the transfer heads are configured to provide a fluid pressure to an article positioned thereon, a gap formed between adjacent pairs of transfer heads so that a portion of the carriage moves through the gap during cutting of the article.

2. The cutting apparatus of claim 1, wherein the cutting assembly further comprises a cutting device-contacting member in contact with a first edge portion of the cutting device, and wherein a nip is formed intermediate a portion of the cutting device-contacting member and a portion of the first edge portion of the cutting device, and wherein the nip is configured to shear an article processed on the cutting apparatus.

3. The cutting apparatus of claim 2, wherein the cutting device-contacting member is biased against the first edge portion of the cutting device.

4. The cutting apparatus of claim 3, wherein the cutting device comprises a blade, wherein the first edge portion is generally flat, wherein the blade comprises a second edge portion generally opposed to the first edge portion, and wherein the second edge portion is beveled.

5. The cutting apparatus of claim 1, wherein the first gear rotates in a first direction, and wherein the cutting device rotates in the same first direction.

6. The cutting apparatus of claim 1, comprising a second cutting assembly joined to the drum and orbiting the longitudinal axis with the drum, the second cutting assembly comprising:

a second rack comprising a first end and a second end, wherein the second rack extends in a direction substantially parallel to the longitudinal axis between the first end and the second end;

a second rack gear assembly comprising:

at least one gear operably engaged with the second rack, wherein the second rack gear is configured to travel at least partially intermediate the first end and the second end of the second rack;

a second cutting device driven by the at least one second rack gear, wherein the second cutting device rotates at faster than the first gear; and a second cam follower at least partially engaged with the track and configured to orbit about the longitudinal axis within the path of the track, wherein the second cam follower is configured to move the at least one second rack gear at least partially intermediate the first end and the second end of the second rack when the second cutting assembly is orbiting about the longitudinal axis.

7. The cutting apparatus of claim 1, wherein the cutting assembly further comprises a support member joined to the drum, wherein the support member comprises a guide, and wherein the cutting device translates relative to the guide when the first gear is moved at least partially intermediate the first end and the second end of the rack or at least partially intermediate second end and the first end of the rack.

8. The cutting apparatus of claim 1, wherein the cutting assembly further comprises a retaining member configured to engage an article to be cut, and wherein the retaining member is biased toward the article to be cut.

9. The cutting apparatus of claim 1, wherein the first gear travels from the first end of the rack to the second end of the rack and back to the first end one time during one full rotation of the drum about the longitudinal axis.

10. A cutting apparatus comprising:

a drive shaft having a longitudinal axis;

a drum configured to orbit about the longitudinal axis when driven by the drive shaft, said drum having an inner surface oriented towards the longitudinal axis and an outer surface opposed thereto and facing away from the longitudinal axis;

a barrel cam positioned at least partially intermediate the drive shaft and a portion of the drum, wherein the barrel cam comprises a track that forms a path that surrounds the longitudinal axis, and wherein the drum and the drive shaft rotate relative to the barrel cam; and a cutting assembly joined to the drum and configured to orbit about the longitudinal axis with the drum, the cutting assembly comprising:

a rack disposed on the outer surface of the drum and comprising a first end and a second end, wherein the rack extends in a direction parallel to the longitudinal axis between the first end and the second end;

a compounding gear assembly comprising:

a plurality of gears comprising a first gear operably engaged with the rack, wherein the first gear is configured to travel at least partially intermediate the first end and the second end of the rack and back;

a cutting device driven by the plurality of gears, wherein the cutting device rotates faster than first gear wherein the first gear rotates in a first direction, and wherein the cutting device rotates in the same first direction; and a cam follower at least partially engaged with the track and configured to orbit about the longitudinal axis within the path of the track, wherein the cam follower is configured to move the first gear at least partially intermediate the first end and the second end of the rack when the cutting assembly is orbiting about the longitudinal axis to cause the cutting device to translate parallel to the longitudinal axis.

11. The cutting apparatus of claim 10, wherein the cutting apparatus comprises a circular blade.

* * * * *